United States Patent [19]

Waters

[11] 4,386,570

[45] Jun. 7, 1983

[54] MAINTENANCE OF RAILWAY TRACK

[75] Inventor: John M. Waters, Derby, England

[73] Assignee: British Railways Board, Great Britain

[21] Appl. No.: 325,385

[22] Filed: Nov. 27, 1981

Related U.S. Application Data

[63] Continuation of Ser. No. 41,394, May 22, 1979, abandoned.

[30] Foreign Application Priority Data

May 23, 1978 [GB] United Kingdom ..... 21274/78

[51] Int. Cl.[3] ..... E01B 27/18

[52] U.S. Cl. ..... 104/11; 238/2

[58] Field of Search ..... 104/10–14; 238/1, 2

[56] References Cited

U.S. PATENT DOCUMENTS

| | | | |
|---|---|---|---|
| 1,041,878 | 10/1912 | Royal | 104/11 |
| 2,669,942 | 2/1954 | Scheuchzer | 104/11 |
| 4,043,271 | 8/1977 | Theurer | 104/12 |

FOREIGN PATENT DOCUMENTS

| | | | |
|---|---|---|---|
| 810032 | 8/1951 | Fed. Rep. of Germany | 104/11 |
| 911616 | 5/1954 | Fed. Rep. of Germany | 104/10 |
| 1020047 | 11/1957 | Fed. Rep. of Germany | 104/11 |
| 433524 | 8/1935 | United Kingdom | 104/13 |
| 689332 | 3/1953 | United Kingdom | 104/11 |
| 697156 | 9/1953 | United Kingdom | 104/11 |

*Primary Examiner*—Randolph Reese

*Attorney, Agent, or Firm*—Hayes, Davis & Soloway

[57] ABSTRACT

A method of re-levelling railway track of the kind having rails fastened to sleepers supported on a ballast bed is disclosed. The method comprises lifting the sleepers off the ballast bed and pneumatically placing ballast stones by an air stream in the gap formed between the underside of a lifted sleeper and the underlying ballast bed using a tool which is driven into the ballast bed adjacent a side face of the sleeper to a depth such that an outlet for the ballast stones propelled by the air stream is provided at the level of the gap. The tool used comprises a spade-like member having a channel along which the air stream and the ballast stones are fed into the gap, the member being disposed so that its channel extends generally downwardly with its mouth facing the sleeper side face and the length of the channel being greater than the depth of the channel. Preferably the length of the channel is such that with the lower end thereof aligned with the gap the channel extends upwardly to a position above the top side of the sleeper.

15 Claims, 13 Drawing Figures

MAINTENANCE OF RAILWAY TRACK

Figure 1:
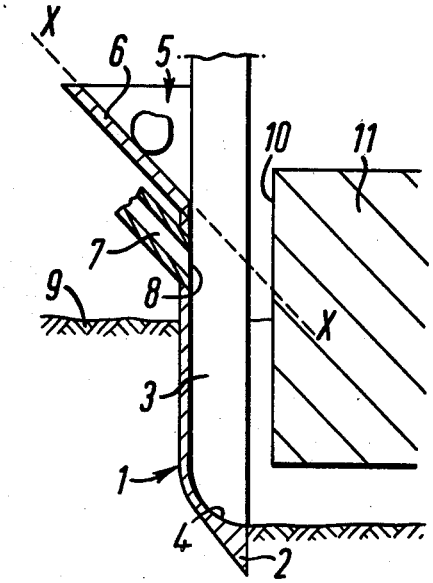

This application is a continuation application of my co-pending application Ser. No. 041,394, filed May 22, 1979, for Maintenance of Railway Track, now abandoned.

This invention relates to the maintenance of railway track.

Conventional railway track comprising rails fastened to sleepers or ties (hereinafter termed sleepers) supported on a ballast bed can be initially laid to a geometric quality that will ensure a comfortable and safe vehicle ride. Loss of geometric quality results however from the track loadings associated with the passage of vehicles over the track. When geometric quality has deteriorated to a sufficient degree the track has to be re-levelled to restore it once again to an acceptable geometric quality.

Prior to 1950 re-levelling of track was normally achieved by digging out the ballast from between sleepers, raising the track on jacks, shovelling ballast stones into the gap thus formed between the underside of the sleepers and the underlying ballast, lowering the sleepers on to the added ballast stones and replacing the ballast between the sleepers. Although this procedure was effective it was both time consuming and labor intensive.

More recently the re-levelling of track has been automated to a large extent using a machine which runs on the track and which has lifting devices for lifting the track and vibrating tines for displacing existing ballast stone from between the sleepers to beneath the sleepers so that when the lifting devices are released the sleepers are supported at the correct height. The track is then re-opened to the passage of vehicles. This method of re-levelling is effective in the short term. However, in the long term the method is not effective for one or more of the following reasons resulting in the need to repeat the re-levelling operation:

(a) The height of the gap between the bottom of the sleeper and the ballast bed is usually less than the size of the stone being tamped (i.e. the existing ballast) which precludes penetration of the gap by the ballast.

(b) Only limited penetration of the gap by the ballast stones takes place because of the limited horizontal reach of the tamping tine.

(c) The gap is filled by dilation of the existing ballast structure resulting from the application of horizontal forces emanating from the tamping tines. The resulting ballast structure is unstable and upon re-application of the vertical load associated with the passage of vehicles the ballast bed will recompact and revert to its original structural arrangement.

(d) The limited supply of ballast stone at the face of the tine.

As early as 1949 another method of track maintenance was proposed which lends itself to automation. This comprises pneumatic placement of ballast stones in the gap formed between raised sleepers and the underlying ballast bed. However, because of certain practical difficulties this method has never come into general use, notwithstanding that it does not suffer from the disadvantage associated with the use of vibrating tines.

An example of pneumatic placement of ballast stones is described in German Patent Specification No. 810032. The arrangement described in this Specification suffers from two serious disadvantages. The first disadvantage is that before the feed tube for the compressed air and ballast stones can be positioned, the ballast at the side of a sleeper to be re-levelled has to be dug out to the desired depth to allow location of the feed tube so that its outlet orifice is directed towards the gap between the underside of the raised sleeper and the underlying ballast bed. The second disadvantage is that should a stone blockage occur in the tube no self-clearing facility is provided.

The first stated disadvantage of the arrangement described in German Patent Specification No. 810032 is overcome in the arrangement described in German Patent Specification No. 911616 and British Patent Specification No. 689332 in that a tool which can be driven into the ballast bed is used. However, they both suffer from the second stated disadvantage that the pneumatic feed arrangement for the ballast stones has no self-clearing facility.

In British Patent Specification No. 697156 a further arrangement for the pneumatic placement of ballast stones is described which would appear to overcome the first stated disadvantage of the method described in German Patent Specification No. 810032 and might overcome the second stated disadvantage although this does not appear to have been appreciated. However, the method described in British Patent Specification No. 697156 can not be carried out effectively because of the arrangement of ballast stone and compressed air feed used.

The object of the present invention is to provide apparatus for the pneumatic placement of ballast stones which does not suffer from the above stated disadvantages of the method described in German Patent Specification No. 810032 and which can be carried out effectively.

According to the present invention there is provided an apparatus for re-levelling railway track of the kind having rails fastened to sleeper supported on a ballast bed, and including means for lifting said sleepers off said ballast bed; an injection tool having an inlet and outlet; means for driving said injection tool into said ballast bed adjacent a face of said sleeper and positioning said tool in said ballast bed so that said outlet faces said sleeper side face at a level below said lifted sleepers; a source of high pressure air; means connecting said source of high pressure air to said injection tool inlet; a source of ballast stones; means connecting said source of ballast stones to said injection tool inlet; and deflection means adjacent said injection tool outlet, the improvement wherein said injection tool comprises an elongated hollow member having a single, open-mouthed channel of U-shaped cross section adjacent its outlet, said channel having a length not less than 1.25 times its depth, said stones being accelerated along said open-mouthed channel by gravity and by said air stream to a relatively high velocity approaching that of said air stream into which said stones are introduced whereby said stones normally are carried along said injection tool open-mouthed channel to said deflection means.

Figure 2:
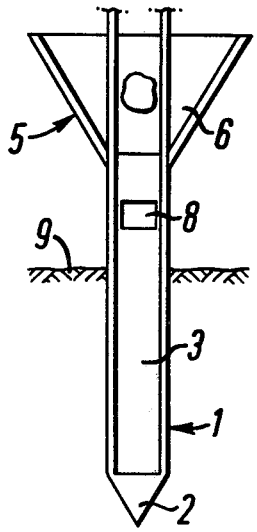
Figure 3:
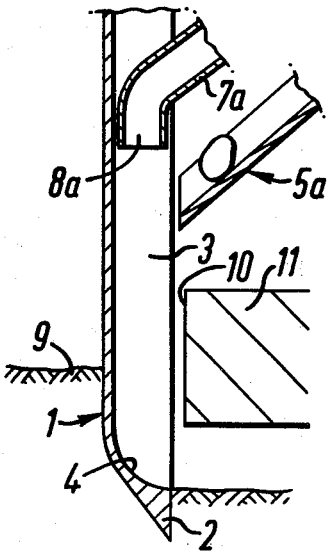
Figure 4:
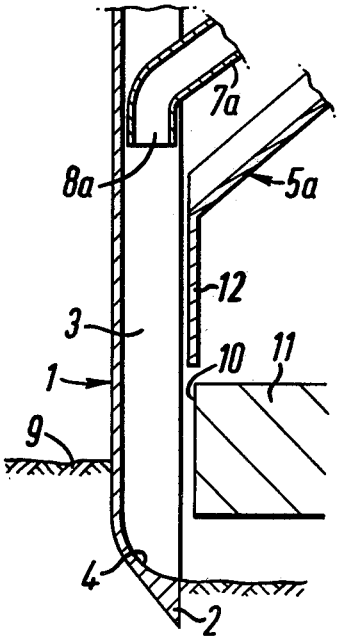
Figure 5:
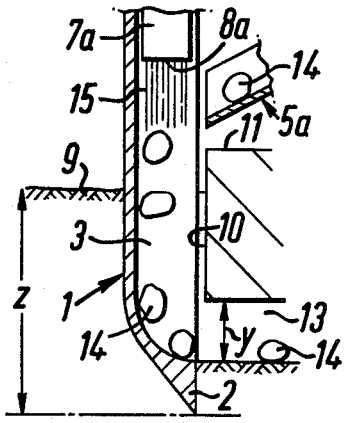
Figure 6A:
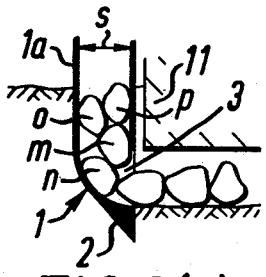
Figure 6B:
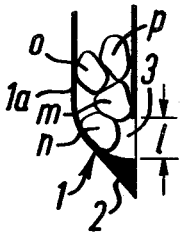
Figure 6C:
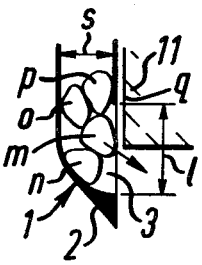

The invention will now be further described by way of example with reference to the accompanying drawings, in which:

FIG. 1 shows in sectional side elevation a first form of tool according to the invention, FIG. 2 shows a front elevation of the same tool FIG. 3 shows a sectional side elevation of a second form of tool according to the invention FIG. 4 shows in sectional side elevation a modification of the tool of FIG. 3, FIG. 5 serves to illustrate the operation of a tool according to the invention, FIGS. 6*a*, 6*b*, and 6*c* serve to explain the self-clearing facility of the tools of the invention, FIG. 6*c* showing a further form of tool in accordance with the invention.

Figure 7A:
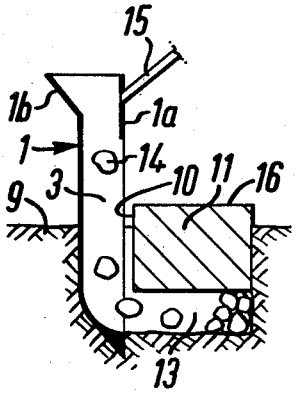
Figure 7B:
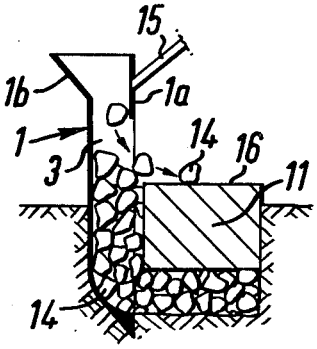
Figure 7C:
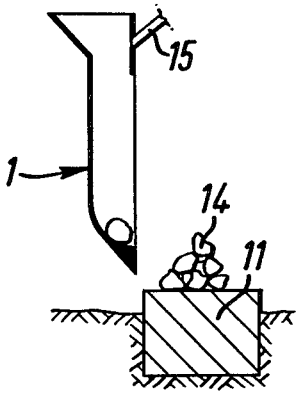

FIGS. 7*a*, 7*b* and 7*c* also serve to explain the self-clearing facility of the tools of the invention and show a still further form of tool in accordance with the invention.

Figure 9:
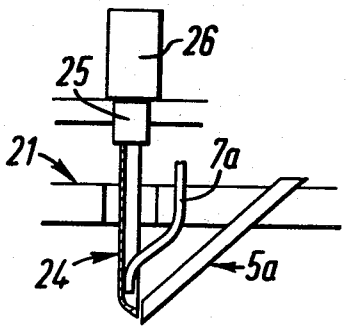
Figure 8:
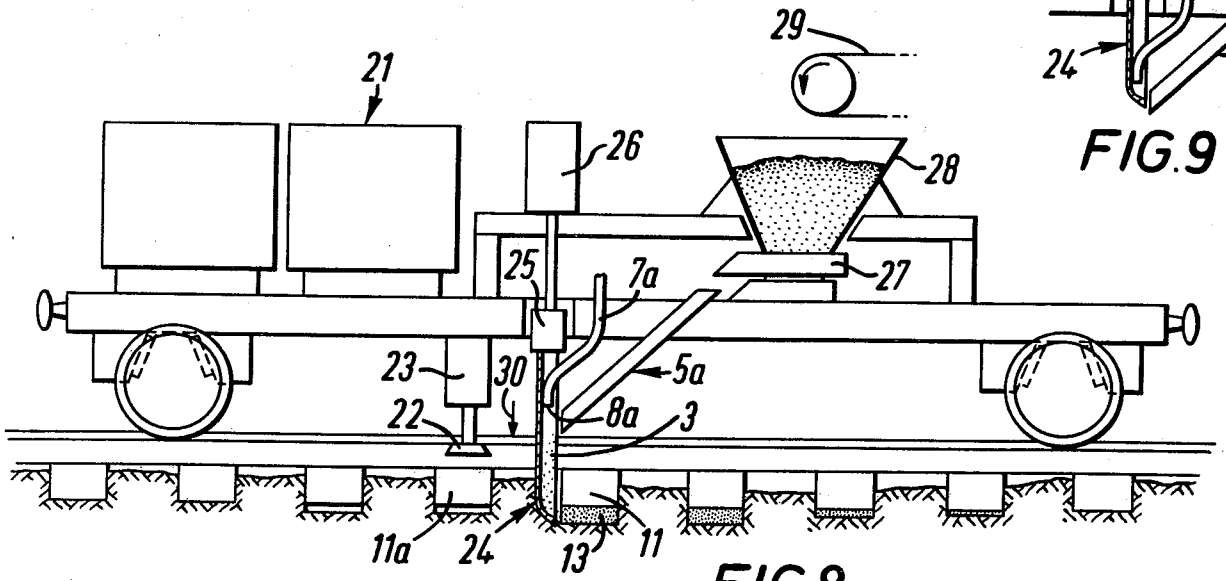

FIG. 8 shows the manner in which the operation of tools of the invention can be automated by mounting the tools and associated equipment on a machine which runs on the track to be maintained and FIG. 9 shows a detail of the machine, The basic arrangement of the invention is to lift a sleeper to a required height for re-levelling and thus create a void or gap between the underface of the sleeper and the underlying ballast bed. This can be achieved by conventional lifting devices which engage the sleeper itself or the heads of the rails. A spade-like tool having a U-shaped cross section forming a channel extending down it is then driven into the ballast bed adjacent a side face of the sleeper with the channel extending downwardly and with the open mouth of the channel facing the sleeper side face, the tool being driven in to a depth such that lower end of the channel opens into the gap formed between the underside of the raised sleeper and the underlying ballast bed. An air stream is then provided along the channel and a predetermined volume of stones are fed into the air stream and are accelerated along the channel by gravity and by the air stream. At the lower end of the channel the stones are deflected by the tool into the gap beneath the raised sleeper and enter the gap at high velocity to give good penetration.

Referring now to FIGS. 1 and 2 one form of the tool comprises a narrow spade-like member 1 having a pointed lower end 2. Extending down the member 1 is a channel 3 of U-shaped cross section which is terminated at its lower end in a curved surface 4. Alternatively the channel could terminate in a planar sloping surface, for example at 45° to the axis of the channel. This leaves the pointed end 2 as a solid portion. At the upper end of the tool is provided a stone chute 5 whose sloping base 6 leads into the upper end of the channel 3. The tool at a position below the chute 5 is provided with an air inlet pipe 7 which leads to air inlet orifice 8 in the base of the channel 3. The chute 5 may be attached to the tool or fixedly mounted independently thereof.

In use when the tool is driven into a ballast bed 9 to the desired depth with the open mouth of the channel 3 facing side face 10 of a sleeper 11, the plane X-X of the sloping base 6 of the chute 5 intercepts the sleeper side face 10 so that stones sliding down the chute 5 are deflected by the sleeper side face 10 down the channel 3. Similarly air issuing from the orifice 8 is deflected by the sleeper side face 10 down the channel.

Referring now to FIG. 3 the basic form of the tool is the same as that of FIG. 1 in that it comprises a member 1 having a pointed lower end 2 and a channel 3 terminated at its lower end by curved surface 4. However, the stone chute 5*a*, which may be fixedly mounted independently of said tool, is arranged at the front of the tool so that stones sliding down it are deflected down the channel by the base, i.e. the back face (or base), of the channel. Also air inlet 7*a* for the tool of FIG. 3 extends into the upper end of the channel 3 so that air issuing from an orifice 8*a*, which may be fixedly mounted independently of said tool, is directed axially or nearly axially down the channel 3. Experiment has shown that divergance of the air stream from the orifice 8*a* with the air flow used (as described hereafter) is typically 10°. Therefore if the orifice 8*a* of the air inlet tube 7*a* is angled at 10° to the axis of the channel 3 in the direction towards the back face of the channel the outer edge i.e. the right hand edge as seen in FIG. 3, of the air stream will coincide with the front (i.e. the mouth) of the channel and air losses out of the front of the channel will be kept to a minimum. It may be desirable to arrange for a small leakage of air between the front of the channel 3 and the side face 10 of the sleeper 11 to provide a positive resistance to the entry of small particles of existing ballast from the ballast bed 9 into the channel 3 via the gap between the mouth of the channel 3 and the sleeper side face 10.

In an alternative arrangement to that of FIG. 3 the orifice 8*a* may be replaced by an air inlet orifice similar to orifice 8 described with reference to FIGS. 1 and 2. Similarly the arrangement of FIGS. 1 and 2 may be modified by substituting an orifice, similar to orifice 8*a* described with reference to FIG. 3, for orifice 8.

The stone chute 5*a* and/or the air feed pipe 7*a* may be integral with the member 1 or separate from it. In the latter case the member 1 may be retracted out of the ballast bed 9 while the chute 5*a* and/or the air feed pipe 7*a* remain stationary.

Referring now to FIG. 4, where as far as possible the same reference numerals as in FIG. 3 have been used, the tool shown in FIG. 3 may be modified by extending the lower end of the chute 5*a* vertically downwards to provide a baffle 12 for air and/or stone.

Referring now to FIG. 5, this illustrates the mode of operation of the tool shown in FIG. 3 but is also generally applicable to the other forms of tool described above. After lifting of the sleeper as described above to create a void or gap 13 of depth 'y', the tool is driven into the ballast bed to a depth 'z'. Stones 14 are then caused to slide or roll down the chute 5*a* into the air stream 15 issuing from the orifice 8*a*. The stones 14 accelerate down the channel 3 until they and the air stream are deflected by the curved surface 4 into the gap 13 beneath the sleeper 11.

The self clearing ability of the tools of the invention will now be described with reference to FIGS. 6*a* to 6*c*. As will become apparent the tool shown in FIGS. 6*a* and 6*b* is not appropriate for the invention whereas the tool shown in FIG. 6*c* is. The tools shown in FIGS. 6*a* and 6*c* are generally similar to those shown in FIGS. 1 to 4 in that each is provided with a pointed lower end 2 and a channel 3. However the tool extends upwardly from the channel 3 as a tubular portion 1*a*. The difference between the tools of FIGS. 6*a* and 6*c* is that the tool of FIG. 6*c* is provided with a longer channel 3. The channel 3 of FIG. 6*a* provides in effect no more than an exit hole for the ballast stones at the lower end of the tubular extension 1*a*.

With the tool shown in FIG. 6*a* should a stone blockage occur such as when the gap 13 beneath the sleeper 11 becomes full, the blockage will not (as indicated in FIG. 6*b*) automatically clear itself when the tool is withdrawn from the ballast bed. If however the length l of the channel 3 is increased as shown in FIG. 6c such a blockage can be cleared upon withdrawl of the tool. The criterion for self-clearing is that the length l of the channel is not less than twice the maximum diameter of the stone being blown through the tool. With this dimensioning the upper stone referenced m and then the stone referenced o and then the stone reference p are able to pass over the lower stone n once the restraint of the sleeper side q is removed by restracting the tool. Since the size of the stone being blown will be less than the depth s of the channel 3, the length l of the channel 3 needs to be greater than the depth of the channel but not greater than twice the depth of the channel 3. In practice it has been found that l should not be less than 1.25 s.

The self clearing ability of the tools of the invention will now be described with reference to FIGS. 7a to 7c. The tool shown in FIGS. 7a to 7c is also similar in principle to those shown in FIGS. 1 to 4 in that it has a member 1 provided with a pointed lower end 2 and a channel 3 of U-shaped cross section. However, the tool extends upwardly from the channel 3 as a tubular portion 1a which opens out at its upper end into a stone hopper 1b. The air stream is supplied via a pipe 15 leading into the tubular extension 1a just below the hopper 1b.

In FIG. 7a stones are shown being blown down the channel 3 of the member 1 and into the gap 13 formed between the sleeper 11 and the underlying ballast bed. It is to be noted that the distance between the upper end of the channel (i.e. its junction with the tubular portion 1a) and the top surface 16 of the sleeper 11 is the same as or greater than the depth of the channel 3 from its front to back surface. In practice the tubular portion 1a should be as long as possible so that the stone accelerates to a high velocity within it so that the momentum of the stone and the air flow carry the stones along the channel 3 where this is situated above the sleeper 11. The same momentum ensures that good penetration of the gap 13 is achieved.

FIG. 7b shows the gap filled with stone, the stone exit from the channel obstructed and the progressive filling of the channel 3. However, the stones do not extend up into the tubular portion 1a where they could jam in position and cause a difficult blockage of the tool but spill out assisted by the air flow on to the top surface 16 of the sleeper through the upper portion of the channel FIG. 7c shows the tool being removed from the ballast bed 9. The stones trapped in the upper portion of the channel 3 of the tool merely fall out of the channel 3 under gravity and as a result of the scouring effect of the air stream 15 which can be maintained while the tool is being retracted.

In experimental trials conducted using the tools described above, successful placement of stones has been achieved under the following operating conditions.

Cross-sectional size of the channel 3 which is rectangular—40 mm×40 mm.

Ballast stone diameter—20–22 mm.

Supply air pressure—6 bar.

Air flow rate at stone exit point—0.1 cu m/sec.

(i.e. at lower end of channel 3).

Air velocity along the channel 3—70 m/sec.

It is to be noted that with the tools described above the air does not issue from a nozzle or other construction into the channel 3 but flows from the supply pipe and along the channel 3 as a steady stream. Since there is no significant expansion of the air stream within the channel and since the momentum of the air in the tubular extension 1a is in the axial direction of the channel 3, the tendency for air to escape out of the channel is minimized.

In addition to the advantages apparent from the above description, the tools of the invention described above has the following further advantages:

1. The simple tool design results in low unit costs.
2. The tool is simple to replace when necessitated by wear or damage.
3. Stones are introduced into the air stream at an early stage and thus achieve a high acceleration and exit velocity from the channel. Good void penetration is thus achieved and the likelihood of a stone blockage being initiated by a stone coming to rest in front of the stone exit point is minimized.
4. It has been shown that a wide spread of stone (typically 90°) in the plane of the ballast bed is achieved by the tools.
5. As the air and stone feeds are combined at a point above the surface of the ballast bed the cross sectional area of the tool can be kept to a minimum which, for any given stone size, in turn keeps ballast disturbance and driving forces to a minimum.
6. Stone and air entry can be effected at any point in the channel in certain configurations of the tool thus allowing the air and stone feeds to be separated from the part of the tool driven into the ballast bed.
7. Since the air and stone feeds can be kept at a constant height with respect to the rails in certain tool configurations greatly simplified mechanization is possible.

The tools described above can in simple manner be incorporated into a mechanized and automated track maintenance machine. An example of such a machine is shown diagramatically in FIGS. 8 and 9 and comprises a vehicle 21 arranged to run on the track to be maintained. The machine has conventional track lifting devices 22 for engaging under the rail heads. The lifting devices 22 are actuated by hydraulic rams 23. For pneumatic placement of ballast stones, tools 24 corresponding in construction to the tool shown in FIG. 3 are provided in this example; the various parts of the tool have therefore been given the same reference numerals as in FIG. 3. In the tool 24 the stone chute 5a and the air supply pipe are fixedly mounted on the vehicle 21 so that they do not move with the member 1 when this is driven into the ballast bed and retracted therefrom as is apparent from FIG. 9. The tool 24 has a driving head 25 through which the tool 24 is driven into the ballast bed and a lifting ram 26 for retracting the tool 24 from the ballast bed. The stone chute 5a is supplied with ballast stones by vibratory stone feed table 27 supplied with stones from hopper 28. The hopper is in turn supplied by conveyor 29.

The machine operates as follows. With the tools 24 retracted (i.e. in the position of FIG. 9) the machine is positioned correctly with respect to the sleeper 11 to be re-levelled. The lifting device 22 is then located under the rail head and the lifting ram 23 operated so that the track is lifted to the required level indicated by arrowhead 30. The ram 26 is then controlled to allow the tool 24 to be lowered such that it is resting on the surface of the ballast bed between the sleepers. The driving head 25 is then activated such that the tool 24 is driven to the correct working level and then stopped.

Compressed air is then introduced into the air supply tube 7*a*. The vibratory stone feed table 27 is activated such that stone from the hopper 28 is fed into the chute 5*a* and thence into the channel 3 of the member 1 to mix with the air issuing from the air outlet 8*a* orifice of pipe 7*a*. Additional stone may be fed into the hopper 28 via the conveyor 29. It should be noted that the stone is projected from the chute 5*a* towards the back of the channel 3. The stone is ejected from the lower end of the channel 3 into the void 13 beneath the sleeper 11. The vibratory stone feed table 27 is stopped once the correct volume of stone has been delivered to the chute 5*a*.

The lifting ram 26 is then activated to lift the tool 24 clear of the ballast bed. The ram 23 is then operated to lower the lifting devices 22 so that the track settles down under its own weight and is once again carried by the ballast bed and the added stone.

The machine is then moved forward such that the tool 24 is positioned correctly with respect to the next sleeper referenced 11*a* to be re-levelled and the cycle of operation is repeated.

The machine shown in FIGS. 8 and 9 may be provided additionally with vibrating tines. The use of vibrating tines to vibrate the ballast bed following the placing of additional stone can be used to advantage. Such vibration induces the added stones to flow over the surface of the original ballast to give a more uniform support to the sleeper. It also breaks down interparticle friction and thereby induces the added stone and the original ballast to interpenetrate. Such interpenetration allows a residual lift of less than the diameter of the added stone to be achieved. It also aids compaction of added stone and reduces the magnitude of any initial hump associated with the stone blowing operation and also reduces subsequent settlements associated with compaction of the added stone.

When the vibration is used in conjunction with a squeezing action (as is associated with the traditional tamping action) further interpenetration of the added ballast is encouraged and also causes the existing ballast to flow up and around the added stone.

It has been shown that the effects referred to above by the use of vibrating tines can be achieved either by applying the vibration and/or squeezing immediately following the addition of stone and prior to moving the machine to the next sleeper or by applying the vibration and/or squeezing subsequent to the completion of the addition of stone to a number of sleepers. It will be clear therefore that the vibration and/or squeezing effect can, if required, be provided by a separate machine e.g. a standard tamping machine.

Following ballast vibration and/or squeezing the track itself can with advantage be vibrated as a means of further enhancing the effects described above and also as a means of increasing lateral track stabilty following maintenance.

I claim:

1. In apparatus for re-levelling railway track of the kind having rails fastened to sleeper supported on a ballast bed, and including means for lifting said sleepers off said ballast bed; an injection tool having an inlet and outlet; means for driving said injection tool into said ballast bed adjacent a face of said sleeper and positioning said tool in said ballast bed so that said outlet faces said sleeper side face at a level below said lifted sleepers; a source of high pressure air; means connecting said source of high pressure air to said injection tool inlet; a source of ballast stones; means connecting said source of ballast stones to said injection tool inlet; and deflection means adjacent said injection tool outlet, the improvement wherein said injection tool comprises an elongated hollow member having a single, open-mouthed channel of U-shaped cross-section adjacent its outlet, said channel having a length not less than 1.25 times its depth, said stones being accelerated along said open-mouthed channel by gravity and by said air stream to a relatively high velocity approaching that of said air stream into which said stones are introduced whereby said stones normally are carried along said injection tool open-mouthed channel to said deflection means.

2. In apparatus according to claim 1, the improvement wherein said injection tool has a chute for feeding said ballast stones into said channel, and wherein said chute is directed towards the mouth of said channel, the plane of the base of said chute intercepting said sleeper side face whereby stones sliding down said chute are deflected by said sleeper side face down said channel.

3. In apparatus according to claim 1, the improvement wherein said injection tool has a chute for feeding said ballast stones into said channel, and wherein said chute is directed towards the base of the U-shaped cross section of said channel whereby stones are deflected by the base of said channel down said channel.

4. In apparatus according to claim 2 or 3, the improvement wherein said means connecting said source of ballast stones is said chute which is fixedly mounted independently of said injection tool.

5. In apparatus according to any one of claims 1 to 3, the improvement wherein said injection tool has an air supply pipe communicating with an orifice in the base of the U-shaped cross-section of said channel, the direction of said air supply pipe and the level of said orifice being such that the air stream issuing from said orifice is deflected by said sleeper side face down said channel.

6. In apparatus according to claim 5, the improvement wherein said air supply pipe is fixedly mounted independently of said injection tool.

7. In apparatus according to any one of claims 1 to 3, the improvement wherein said injection tool has an air supply pipe directed substantially axially of said channel.

8. In apparatus according to claim 7, the improvement wherein said air supply pipe is directed slightly towards the base of the U-shaped cross-section of said channel, so that the outer edge of the diverging air stream issuing therefrom is directed along the mouth of said channel.

9. In apparatus according to any one of claims 1 to 3, the improvement wherein said injection tool has an air supply pipe directed substantially towards the base of the U-shaped cross-section of said channel.

10. In apparatus according to claim 1, the improvement wherein said injection tool has a tubular extension above said channel along which said ballast stones and said air flow are fed prior to entering said channel.

11. In apparatus according to claim 1, the improvement wherein the lower end of said channel terminates in a curved surface which leads into the gap between said ballast bed and said lifted sleepers.

12. In apparatus according to claim 1, the improvement wherein said injection tool has a pointed lower end.

13. In apparatus according to claim 1, the improvement which comprises means for vibrating said ballast bed following placement of said ballast stones.

14. In apparatus according to claim 1, the improvement which comprises means for squeezing said ballast bed following placement of said ballast stones.

15. In apparatus according to claim 1, the improvement wherein said channel has a length greater than the height of a sleeper side face such that with said outlet at a level below the lifted sleepers the upper end of said open-mouthed channel is above the level of said lifted sleepers.

* * * * *